US006079488A

United States Patent [19]

Begg et al.

[11] Patent Number: 6,079,488

[45] Date of Patent: Jun. 27, 2000

[54] LATERAL LINER TIEBACK ASSEMBLY

[75] Inventors: Stephen M. Begg, Edmonton; Grant E. E. George, Calgary, both of Canada

[73] Assignee: Schlumberger Technology Corporation, Sugar Land, Tex.

[21] Appl. No.: 09/079,277

[22] Filed: May 15, 1998

[51] Int. Cl.[7] ..... E21B 17/02; E21B 43/14

[52] U.S. Cl. ..... 166/50; 166/242.6

[58] Field of Search ..... 166/50, 242.6, 166/242.7; 285/132.1

[56] References Cited

U.S. PATENT DOCUMENTS 4,603,743 8/1986 Lindsey, Jr. ..... 166/382

5,439,051 8/1995 Kennedy et al. ..... 166/50

5,680,901 10/1997 Gardes ..... 166/313

5,787,987 8/1998 Forsyth et al. ..... 166/313

*Primary Examiner*—George Suchfield

*Attorney, Agent, or Firm*—Jeffrey E. Griffin; Jamie A. Castano; John J. Ryberg

[57] ABSTRACT

The invention relates to a tieback hanger for connecting the liner of a lateral well bore to the parent well bore. The tieback hanger includes a spring which maintains a constant force on the tieback hanger to prevent it from protruding into the parent well bore.

15 Claims, 5 Drawing Sheets

LATERAL LINER TIEBACK ASSEMBLY

FIELD OF THE INVENTION

This invention is directed to a well bore liner and, in particular, to a liner tieback assembly for a lateral well bore.

BACKGROUND OF THE INVENTION

A lateral well bore is drilled off a primary well bore at a position along its length. The lateral well bore is drilled through the casing or through a preformed window in the casing of the primary well bore. Completion of these lateral well bores often involves introduction of a liner thereto.

The liner is inserted through the window in the casing and into the lateral well bore. According to one method, the liner is then cemented in place and any end protruding into the primary well bore is milled off. According to another method, the liner is hung off the primary well bore casing by a tieback hanger. The tieback hanger is formed as an open ended tube. The first end of the tube conforms to the shape of the window and is often inclined relative to the long axis of the tube. The opposite end of the tube is connected to the lateral liner. At the first end, the tieback hanger has formed thereon a flange, or other engagement means, for catching on the edges of the casing.

When the liner is in place in the lateral well bore and run in pressure is released, the liner tends to recoil back towards the primary well bore. Sometimes recoiling causes the liner and the attached tieback hanger, if any, to be displaced back into the primary well bore. The liner or tieback hanger then becomes an obstruction to the passage of downhole tools through the primary well bore past the lateral well bore.

SUMMARY OF THE INVENTION

A tieback hanger has been invented which accommodates recoiling of the lateral well bore lining assemblies to prevent these assemblies from being displaced into the primary well bore.

In accordance with a broad aspect of the present invention, there is provided a well bore tieback hanger comprising a first tube having a first end and an opposite end and having a flange extending from its first end; a second tube formed to be connectable to a well bore liner, the second tube being connected adjacent the opposite end of the first tube and moveable relative to the first tube; and an elastic member connected to act between the first tube and the second tube to bias the first tube toward the second tube.

The tieback hanger of the present invention is intended for use in latching the liner of a lateral well bore to the side wall of a primary well bore and acts as an interface between the primary well bore and the lateral liner. As would be understood, the primary well bore can be the well bore leading to surface or another well bore from which a lateral bore has been drilled.

The tieback hanger and attached liner are inserted through a window formed in the sidewall of the primary well bore. The window is the opening to the lateral well bore. The window is preferably preformed in the casing of the well bore. However, the window can alternately be formed by drilling through the well bore side wall at the time of formation of the lateral well bore.

The first end of the first tube preferably substantially conforms to the peripheral shape of the window. In particular, preferably the first end is open and inclines relative to the long axis of the tube.

The flange is formed on the first end of the first tube to latch against the periphery of the window when the tieback hanger is inserted into the lateral well bore. The flange is formed in any suitable way to latch against the periphery of the window. For example, the flange can be complete or partial and can be formed integral with or attached to the first tube in any suitable way.

The second tube is formed in any suitable way for connection to the lateral liner. In one embodiment, the second tube has formed thereon threads for threaded connection to the lateral liner either directly or through a coupling. The second tube can be connected to the first tube in any suitable way to be movable longitudinally relative to the first tube. As an example, the second tube can be telescopically mounted about or within the first tube. Alternately or additionally, the second tube can be connected to the first tube through the elastic member.

The elastic member is attached to act between the first tube and the second tube to bias these tubes together. In one embodiment, the elastic member is formed separately from the first tube and the second tube is connected between the tubes by means such as, for example, by welding, by threaded connections, by fasteners, by a housing or by combinations thereof. In another embodiment, the elastic member is formed integral with one of the first or the second tubes. The elastic member can be any suitable means for biasing the tubes together, with a consideration as to the bore hole conditions. In one embodiment, the elastic member is a coil spring. In another embodiment, the elastic member is a tubular, thin walled spring. In one embodiment, the tieback hanger includes a means for preventing over extension of the elastic member.

To facilitate insertion of the liner into the lateral well bore, preferably, the tieback hanger includes a swivel selected to act between the first end of the first tube and the lateral liner to which the tieback hanger is to be attached. The swivel accommodates torsional and/or sideways forces generated between the tieback hanger and the lateral liner. In the preferred embodiment, the swivel permits the flange end of the tieback hanger to rotate relative to the liner and to flex out of longitudinal alignment with the liner. This facilitates both the insertion of the liner and tieback hanger into the lateral well bore and the latching of the flange onto the periphery of the window. The swivel can be positioned anywhere along the length of the tieback hanger.

Where the elastic member connects between the first tube and the second tube, a tubular member can be disposed between the tubes to facilitate flow between the first and second tubes. The tubular member can be telescopically disposed within or about the elastic member. In one embodiment, the tubular member is connected at one end only to either the first tube or the second tube.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
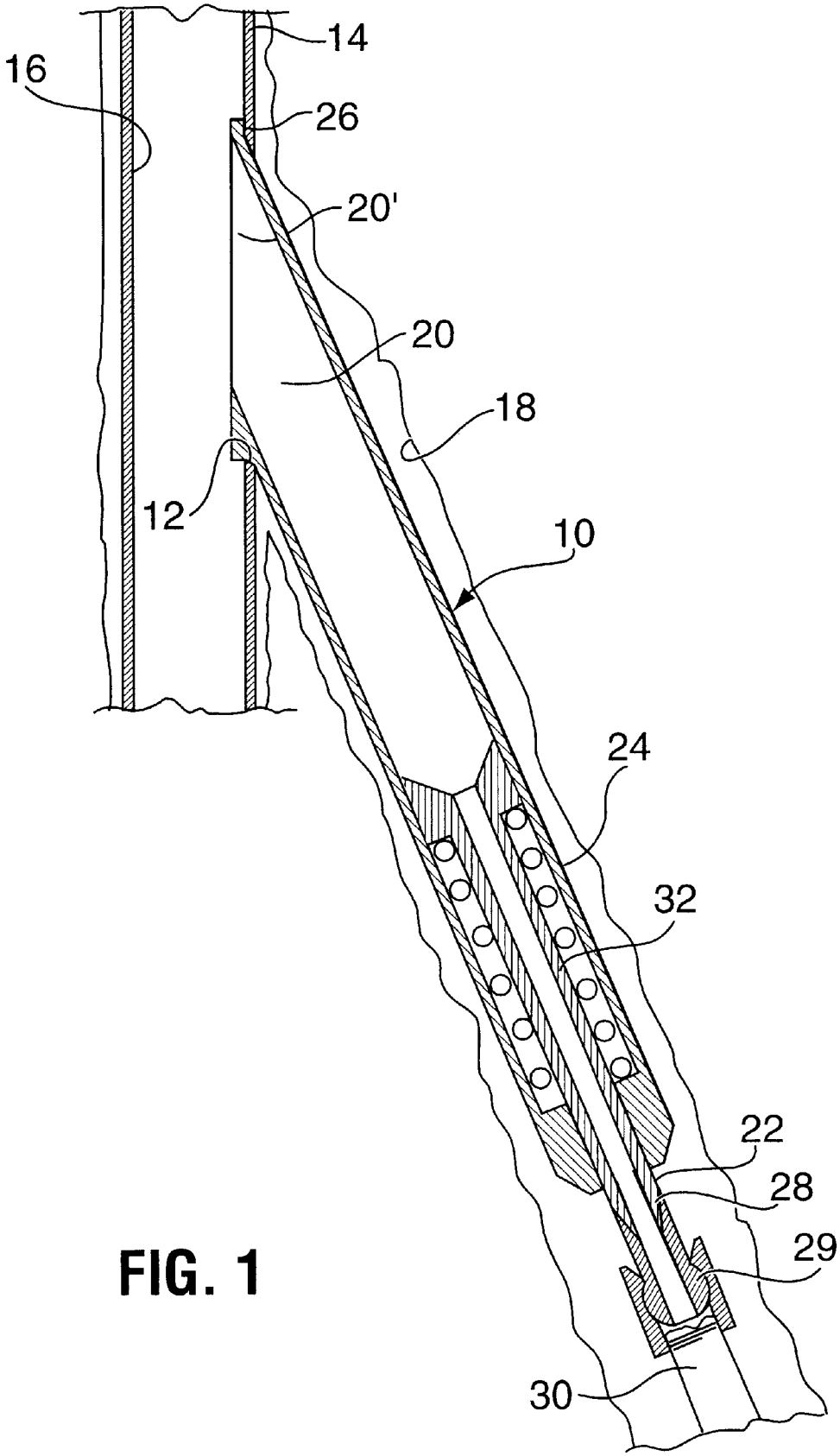
FIG. 1 shows a sectional view through a well bore having disposed therein a tieback hanger according to the present invention.

Referring to FIG. 1, a tieback hanger 10 according to the present invention is shown latched to a window 12 formed though the casing 14 of a primary well bore 16. The main body of tieback hanger 10 is disposed within a lateral well bore 18.

Tieback hanger 10 includes a first tube 20, a second tube 22 and, connected therebetween and securing tube 20 to tube 22, an elastic member 24 such as a spring. Formed at the first end 20' of tube 20 is a continuous flange 26 for latching against the periphery of window 12. In particular, flange 26 is of a size that it cannot pass through window 12, but abuts against the edges of the window.

At the opposite end of the tieback hanger, tube 22 forms a pin end 28 for threaded connection to a swivel 29 and, through the swivel to a lateral liner 30. The liner can be standard-type, slotted, prepacked or modified in any other way.

Elastic member 24 has a selected tension suitable to bias first tube 20 toward second tube 22. Second tube 22 is longitudinally moveable relative to, but remains connected to, first tube through elastic member 24.

The components of the tieback hanger including the first and second tubes, the elastic member and the flanges are formed of a material, for example L-80 pipe or 4140 18–22 rc steel, which is capable of withstanding downhole conditions.

Tieback hanger 10 acts to prevent the tieback hanger and the liner from being displaced, by thermal expansion, into primary well bore 16. In use, tieback hanger 10 is connected to lateral liner 30 at surface. A running tool (not shown) is inserted through hanger 10 and is secured to liner 30 in a way that would be readily appreciated in the art. The liner is then introduced to the primary well bore 16 and inserted, liner end first, through window 12 into lateral well bore 18.

Lateral liner 30 is moved into well bore 18 until flange 26 of first tube 20 abuts against the periphery of window 12. Once flange 26 abuts against window 12, lateral liner 30 and attached second tube 22 are inserted a selected additional distance into well bore 18 against the tension in elastic member 24. The selected distance is selected to be greater than the distance that the lateral liner would be displaced under the thermal conditions in the well and during production and is selected to be less than the distance which would exceed the plastic limit of the elastic member. The weight of the liner prevents the elastic member from drawing the liner toward the primary well bore. This places elastic member 24 under tension so that flange 26 of tieback hanger 10 is pulled against the periphery of the window. If liner 30 expands and is displaced toward the primary well bore, this displacement will be accommodated in the elastic member, while the tension of the spring will maintain flange 26 in engagement with the window.

Preferably, as shown, a tubular member 32 is attached to tube 22 to extend through the elastic member to provide a fluid conduit through the elastic member. Tubular member 32 is free to slide within tube 20.

Figure 2:
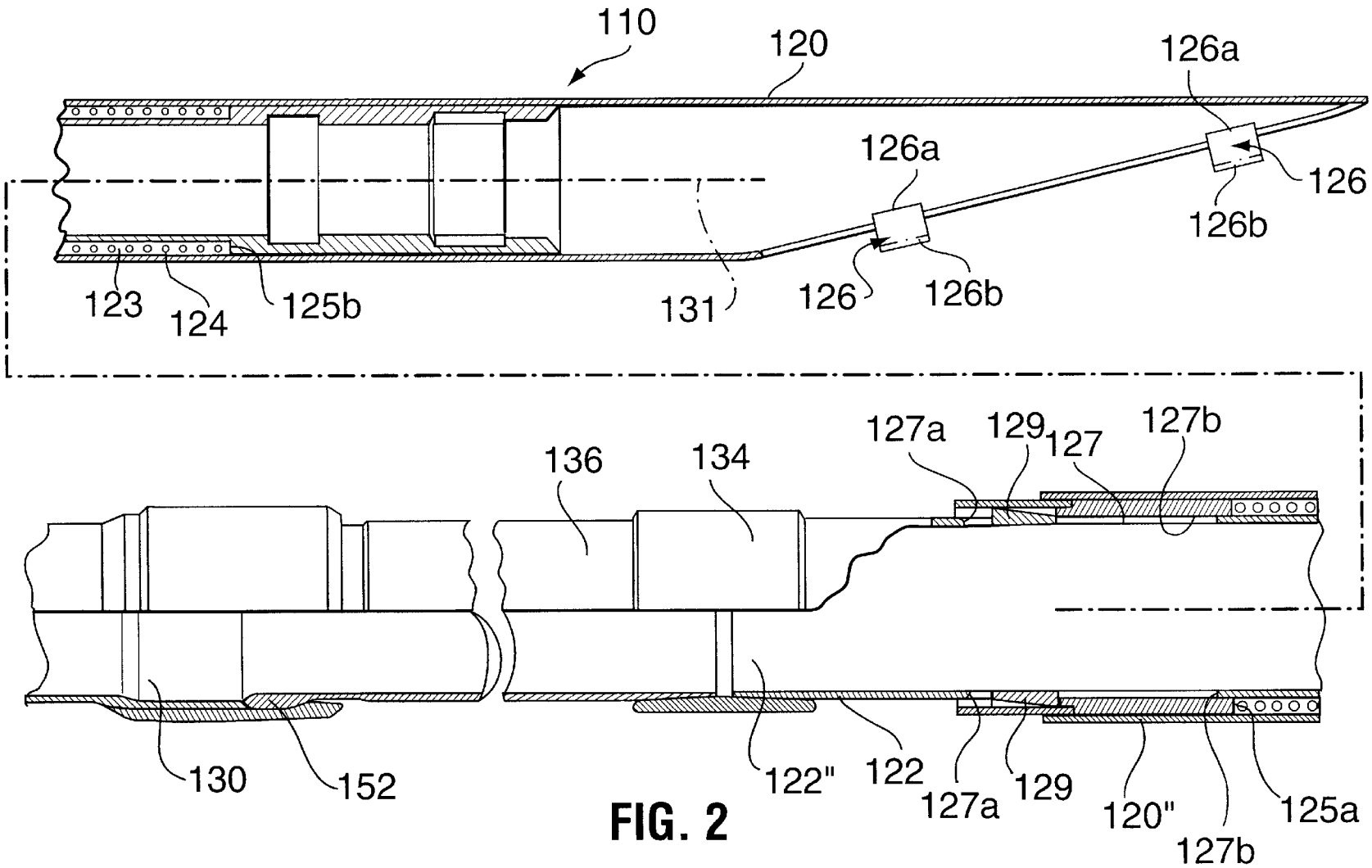
FIG. 2 shows a sectional view through a tieback hanger according to the present invention.

Referring to FIG. 2, another tieback hanger 110 according to the present invention is shown. The tieback hanger includes a first tube 120 and a second tube 122. The first and second tubes can each be formed as one part members or, alternately, to facilitate manufacture, the tubes can be formed of a plurality of parts secured together by welding, threaded engagement or frictional engagement.

First tube 120 is telescopically disposed about tube 122 at one end 120". An annular chamber 123 is formed between the tubes and a coil spring 124 is retained therein. Spring 124 acts between an abutting shoulder 125*a* secured on tube 120 and another abutting shoulder 125*b* formed on tube 122. Spring 124 is compressed between shoulders 125*a* and 125*b* such that tube 120 is biased toward and into overlapping relation with tube 122.

Longitudinal slots 127 are formed on tube 122. Tube 120 has rigidly connected at its overlapping end 120" a plurality of radially inwardly extending keys 129 which engage in slots 127. The cooperation of keys 129 and slots 127 maintains the connection between tube 122 and tube 120 and acts to prevent the tubes from rotating relative to each other and maintains the tubes in alignment.

End 120' of tube 120 is inclined relative to the long axis 131 of the tieback hanger to conform to the periphery of a lateral well bore window. The angle of inclination of end 120' is selected based on the angle at which the lateral well bore is drilled off the primary well bore. Four flanges 126 (only two can be seen in the sectional view) are mounted, as by welding, about end 120'. Each flange 126 includes a first wall 126*a* mounted onto tube 120 and a second wall 126*b* (shown in phantom) formed substantially orthogonally relative to the first wall.

End 122" of tube 122 is attached by means of a coupling 134 to a short section of tubing 136 having integral therewith a swivel ball member 152 for use in the rotational and pivotal attachment of a lateral well liner 130.

Generally, it is desirable that the inner diameter (ID) or the outer diameter of any insert into a lateral well bore liner are not substantially different in than the ID and OD of the liner. Thus, preferably the inner diameter of the tie back assembly is no smaller than the inner diameter of the lateral liner and preferably this is accomplished without increasing the OD beyond acceptable levels.

Figure 3:
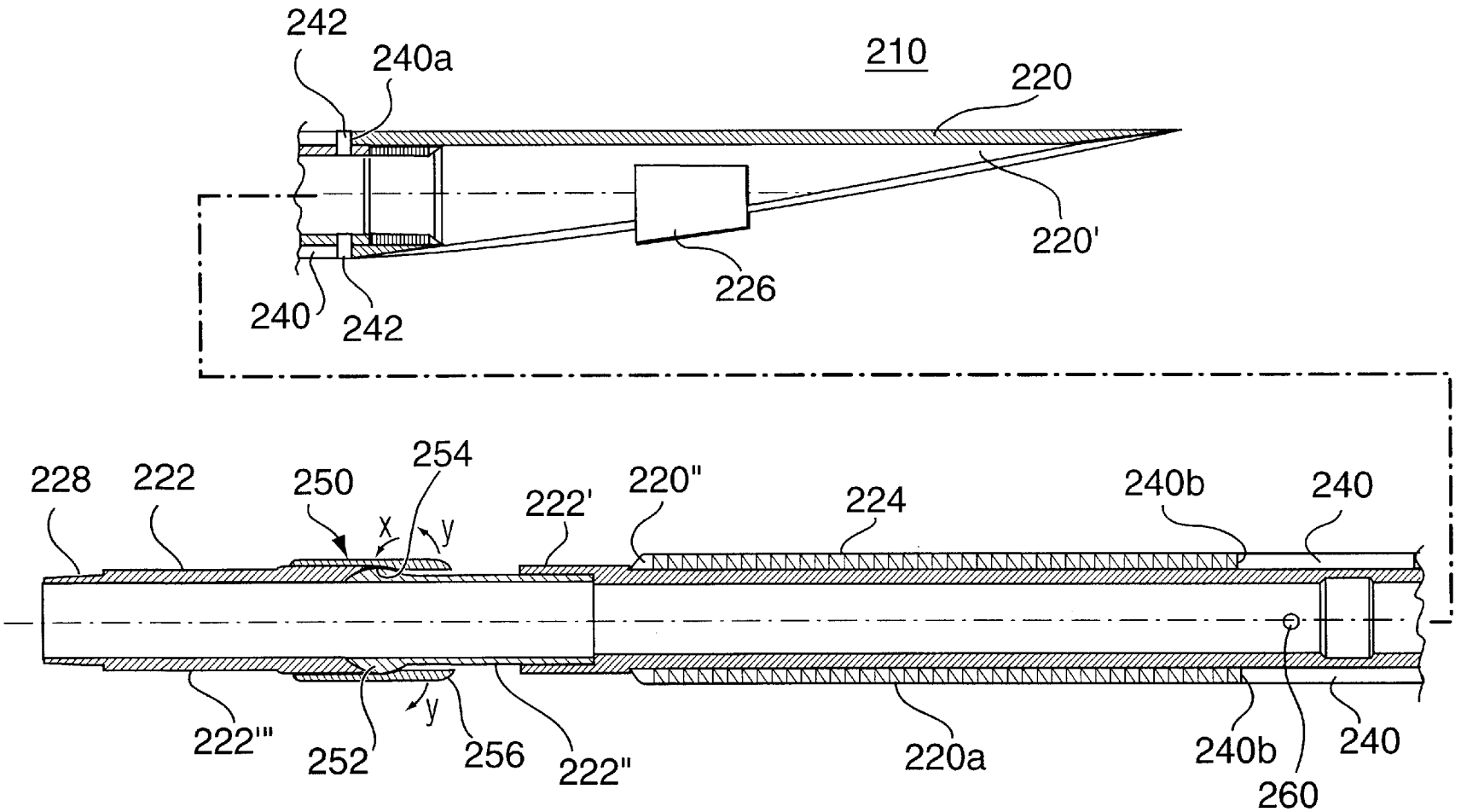
FIG. 3 shows a sectional view through another embodiment of a tieback hanger according to the present invention.

Referring to FIG. 3, another tieback hanger 210 according to the present invention is shown. The tieback hanger includes a thin walled spring 224. A thin walled spring, such as that shown, is particularly useful in the present invention since such a spring can be used both without increasing the OD, and without decreasing the ID, of the tieback hanger beyond acceptable ranges.

Tieback hanger 210 includes a first tube 220 and a second tube 222. Tube 220 is telescopically disposed over tube 222 at its end 220".

Figure 4:
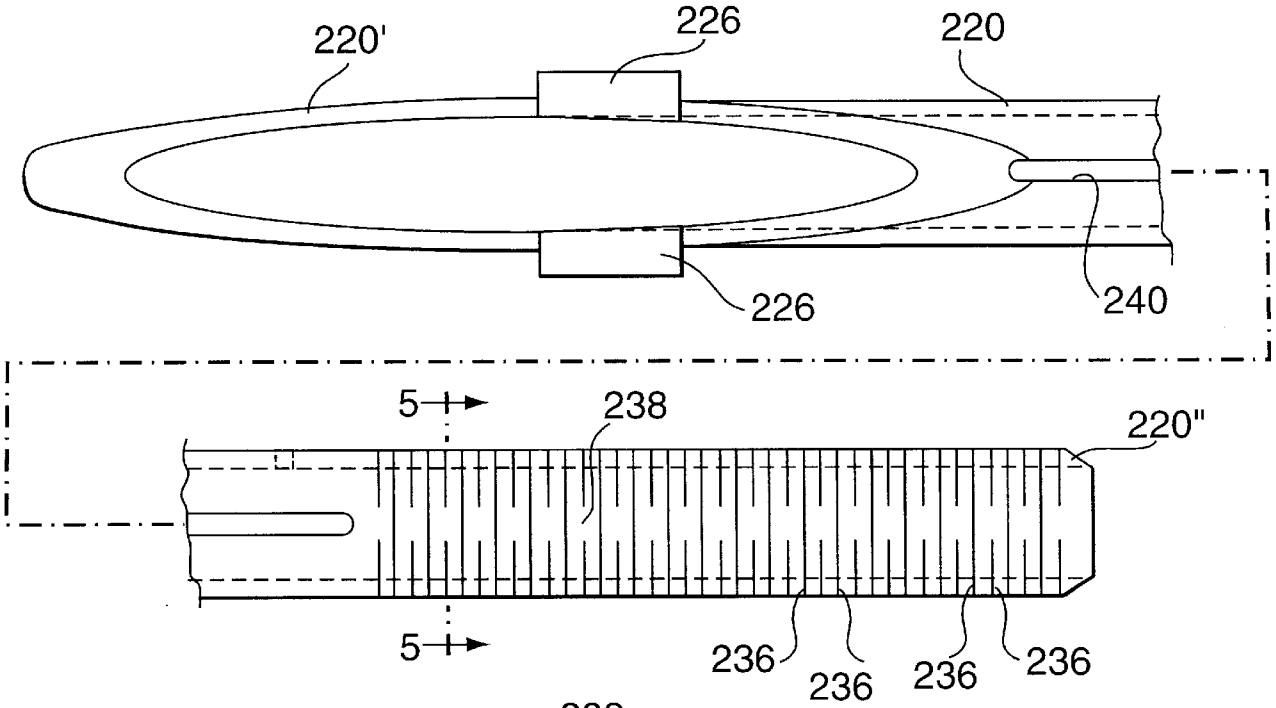
FIG. 4 is a top plan view of the first tube of the tieback hanger of FIG. 3.
Figure 5:
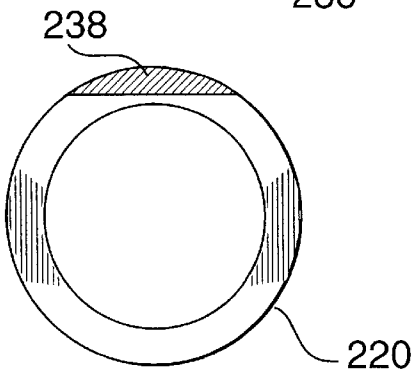
FIG. 5 is a sectional view along line 5—5 of FIG. 4

Spring 224 is formed integral with tube 220. In particular, a portion 220*a* of tube 220 is formed as a spring. Referring particularly to FIGS. 4 and 5, the spring is formed by making a plurality of circumferential cuts 236 in the tube. Cuts 236 extend through a portion of the cross sectional area of each tube leaving a portion 238 attached. The cuts are formed preferably at regular intervals (i.e. every 0.34 inches) and the portion 238 in each adjacent cut alternates, preferably 180°, around the circumference of the tube. When force is applied to pull the ends 220' 220" of the tube apart at the cut, portion 238 acts as a hinge at each cut about which the tube can flex.

To prevent tube 220 from rotating about tube 222, two slots 240 are formed through tube 220 and a pin 242 is engaged to tube 222 through each slot 240. Thus, tube 220 can ride over tube 222 until limited by abutment of each screw 242 against the end walls 240*a*, 240*b* of its slot but positioning of pins 242 in slots 240 prevents rotation of tube 220 about tube 222.

Two flanges 226 are positioned about end 220' of tube 220. The flanges are secured to the tube by welding.

Tube 222 is formed of three connected parts: first end tube 222'; a middle tube 222"; and a liner attachment end tube 222"'. Liner attachment end tube 222"' is formed as a pin end 228. Middle tube 222" and end tube 222"' are connected by means of a swivel 250. Swivel 250 includes a ball member 252 formed on an end of tube 222" which is retained in a spherical cavity 254 defined by an end of tube 222"' and by a coupling 256. Ball member 252 is rotatable within cavity 254 but is retained therein. Thus, end tube 222"' can rotate about the long axis 231, as shown by arrow x, of the tieback hanger. Swivel 250 also provides that the tie back hanger can bend, as shown by arrow y, such that the long axis of tube 222"' can move out of alignment with long axis 231 of the remainder of the tool. This facilitates insertion of the tieback hanger and its attached liner into a lateral well bore.

To facilitate surface indication of spring tensioning, a shear screw 260 is positioned between tubes 222 and 220. When flanges 226 latch against the window, further weight on the tube 220 will cause screw 260 to shear. This shearing is indicated at surface by an increase in weight It is to be understood that tubes 222' and 222" could be formed integral, but are formed separately in the illustrated embodiment for ease of manufacture.

In one embodiment, the tubes 220 and 222 are formed of steel pipe have ⅜ to ½ inch wall thickness. The spring portion is about 20 inches in length and the total tension in the tieback hanger spring is 500 to 1,000 lbs.

Figure 6A:
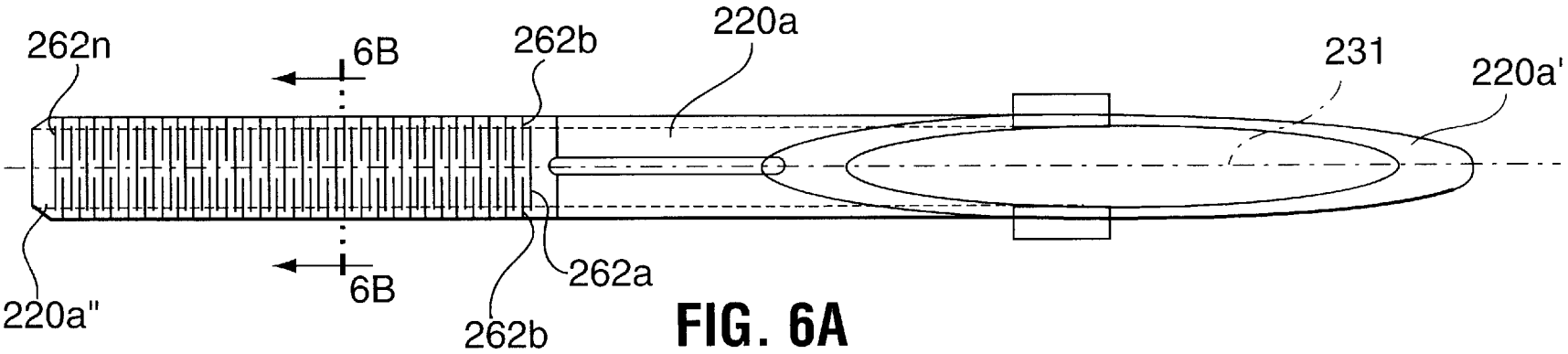
FIG. 6A is a top plan view of a tube including a thin walled tubular spring useful in the present invention.
Figure 6B:
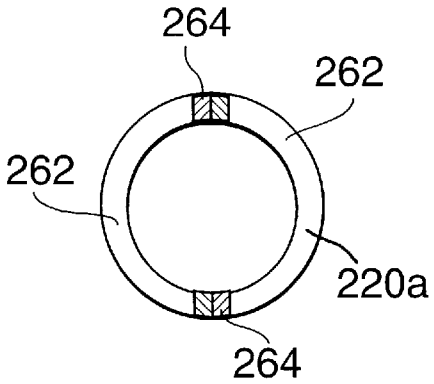
FIG. 6B is a sectional view along line 6B—6B of FIG. 6A

Referring to FIGS. 6A and 6B, another spring construction is shown. The spring is formed by making a plurality of pairs of circumferential cuts 262*a*, 262*b* . . . 262*n* in a tube 220*a*. Each pair of cuts 262 are positioned at substantially the same point along the long axis 231 of the tube and extend through a portion of the cross sectional area of the tube leaving two spaced apart connections 264. The pairs of cuts are formed preferably at regular intervals (i.e. every 0.34 inches) and the connections 264 in each adjacent cut alternates, preferably 180°, around the circumference of the tube. When force is applied to pull the ends 220*a*' 220*a*" of the tube apart at the cut, connections 264 act as hinges at each pair of cuts about which the tube can flex. This spring formation is particularly preferred for larger size tie back assemblies for use with liners of about 5.5" OD and greater.

It will be apparent that many other changes may be made to the illustrative embodiments, while falling within the scope of the invention and it is intended that all such changes be covered by the claims appended hereto.

The embodiments of the invention in which an exclusive property or privilege is claimed are defined as follows:

1. A well bore tieback hanger comprising a first tube having a first end and an opposite end and having a flange extending from its first end; a second tube formed to be connectable to a well bore liner, the second tube being connected adjacent the opposite end of the first tube and moveable relative to the first tube; and an elastic member connected to act between the first tube and the second tube to bias the first tube toward the second tube.

2. The tieback hanger of claim 1 wherein the second tube is connectable to the well bore liner by threaded connection.

3. The tieback hanger of claim 1 wherein the second tube is telescopically mounted about the first tube.

4. The tieback hanger of claim 1 wherein the second tube is telescopically mounted within the first tube.

5. The tieback hanger of claim 1 wherein the second tube is connected to the first tube through the elastic member.

6. The tieback hanger of claim 1 wherein the elastic member is formed separately from the first tube and the second tube.

7. The tieback hanger of claim 1 wherein the elastic member is formed integral with one of the first tube and second tube.

8. The tieback hanger of claim 1 wherein the elastic member is a coil spring.

9. The tieback hanger of claim 1 wherein the elastic member is a tubular, thin walled spring.

10. The tieback hanger of claim 1 further comprising a means for preventing over extension of the elastic member.

11. The tieback hanger of claim 1 wherein the second tube includes an end for connection to a lateral liner and the tieback hanger further comprising a swivel selected to act between the first end of the first tube and the end for connection to a lateral liner.

12. The tieback hanger of claim 1 wherein a tubular member is positioned between the first tube and the second tube.

13. The tieback hanger of claim 12 wherein the tubular member is telescopically disposed within the elastic member.

14. The tieback hanger of claim 12 wherein the tubular member is telescopically disposed about the elastic member.

15. The tieback hanger of claim 12 wherein the tubular member is connected at one end to one of either the first tube or the second tube.

* * * * *